US005715852A

United States Patent [19]

Jepsen

[11] Patent Number: 5,715,852

[45] Date of Patent: Feb. 10, 1998

[54] METHOD AND APPARATUS FOR THE CLEANING OF CLOSED COMPARTMENTS

[75] Inventor: Erik Lund Jepsen, Vaerloese, Denmark

[73] Assignee: Toftejorg A/S, Ishoej, Denmark

[21] Appl. No.: 687,514

[22] PCT Filed: Feb. 7, 1995

[86] PCT No.: PCT/DK95/00055

§ 371 Date: Sep. 30, 1996

§ 102(e) Date: Sep. 30, 1996

[87] PCT Pub. No.: WO95/21033

PCT Pub. Date: Aug. 10, 1995

[30] Foreign Application Priority Data

Feb. 7, 1994 [DK] Denmark ..... 0159/94

[51] Int. Cl.[6] ..... B08B 3/02; B08B 9/12

[52] U.S. Cl. ..... 134/167 R; 239/227

[58] Field of Search ..... 134/167 R, 168 R; 239/227

[56] References Cited

U.S. PATENT DOCUMENTS

| | | | |
|---|---|---|---|
| 3,472,451 | 10/1969 | Orem et al. | 239/227 |
| 3,601,136 | 8/1971 | Marcham | 134/167 R |
| 3,874,594 | 4/1975 | Hatley | 239/227 |
| 4,244,524 | 1/1981 | Wellings | 134/167 R X |

FOREIGN PATENT DOCUMENTS

| | | | |
|---|---|---|---|
| 26377 | 1/1954 | Finland | 134/168 R |
| 2196 446 A | 4/1988 | United Kingdom . | |
| 2 231 487 A | 11/1990 | United Kingdom . | |

*Primary Examiner*—Philip R. Coe

*Attorney, Agent, or Firm*—McAulay Fisher Nissen Goldberg & Kiel, LLP

[57] ABSTRACT

An apparatus for cleaning the inside surfaces of a tank with a jet of fluid from a nozzle lowered into the interior of the tank. The nozzle is capable of being rotated around a first axis and also capable of being swivelled upward and downward in an oscillating movement around a second axis at right angles to the first axis in a predetermined manner. A drive mechanism for the nozzle includes a turbine driven by a stream of fluid with a drive connected to the turbine.

6 Claims, 6 Drawing Sheets

METHOD AND APPARATUS FOR THE CLEANING OF CLOSED COMPARTMENTS

BACKGROUND OF THE INVENTION

Figure 1:
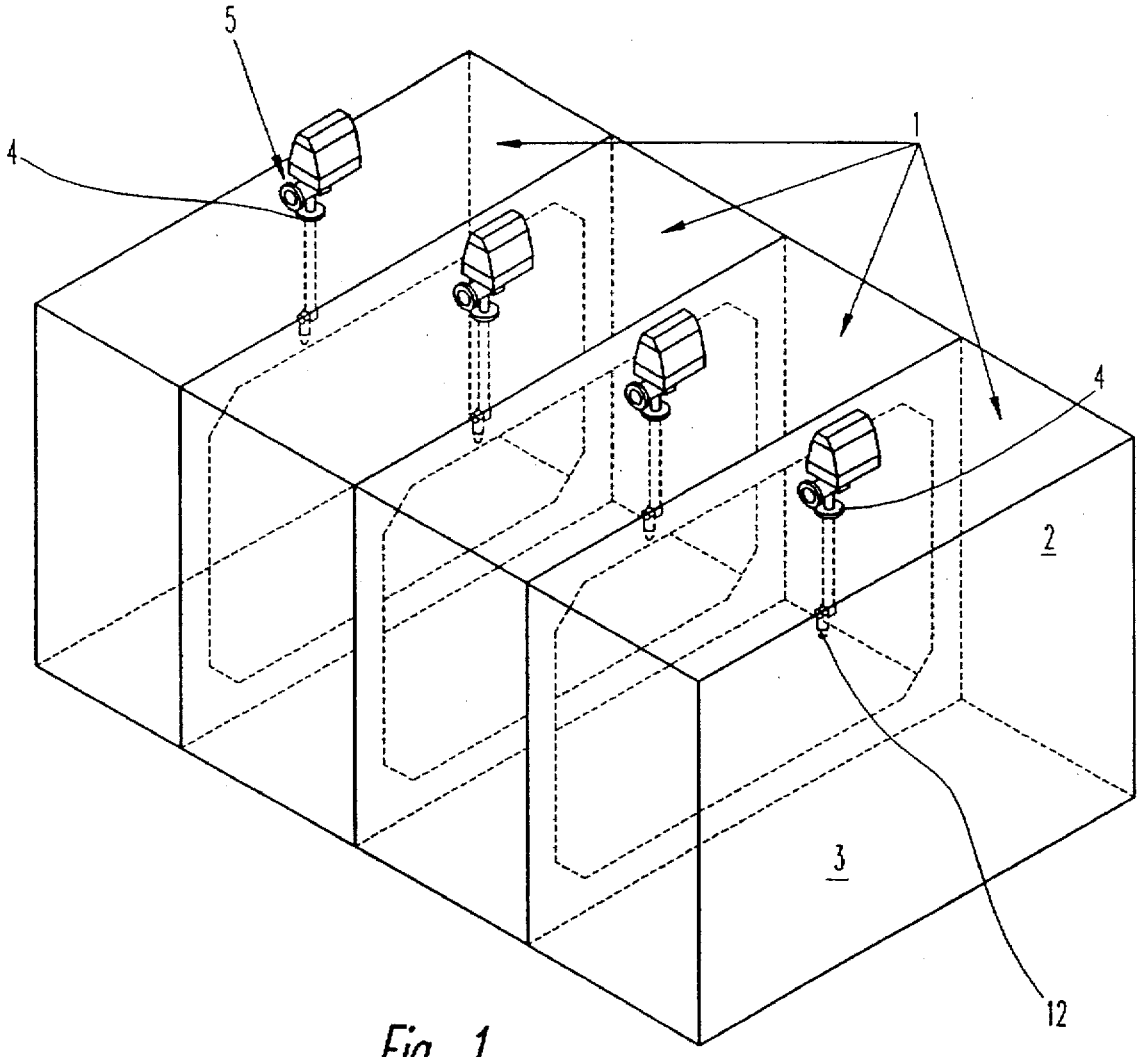

The invention relates to an apparatus for the cleaning of the inside surfaces of a tank or similar space by means of a jet of fluid from a nozzle lowered into the interior of the tank, said nozzle being capable of being rotated around a first axis and also swivelled, oscillated, around a second axis at right-angles to said first axis in a predetermined manner, so that the jet of fluid is traversed around at the same time that it is moved upwards and downwards inside the tank and comprising a turbine driven by a stream of fluid which, via a drive, gives rise to rotation of the nozzle.

The interior of a tank, such as an oil storage tank on a ship, containers, vessels and the like, must at intervals be cleaned of sludge and other impurities which are deposited on the inside surfaces of the tank.

This is usually carried out by means of a cleaning apparatus which can be mounted permanently on the tank, and which is provided with a nozzle mounted on the end of a shaft which extends a suitable distance down into the tank.

The nozzle is supplied with cleaning fluid under pressure which is discharged while the nozzle is brought to move in a predetermined pattern, so that the cleaning fluid systematically hits and sweeps all surfaces and hereby dissolves and flushes away the sludge deposits which hereafter can be led out together with the fluid.

By means of a drive unit in the apparatus, the nozzle can both be turned around in relation to the shaft in a horizontal plane and swung up and down in a vertical plane. It is hereby ensured that the cleaning pattern is one which ensures an effective sweeping of all surfaces.

From U.S. Pat. No. 3,874,594 a tank washing machine with selective wash programming is known, in which washing liquid is discharged from a nozzle mounted on a housing which is rotatable about a first axis (e.g. vertical) in relation to other normally fixed parts of the machine. The nozzle is rotatable or pivotable about a second axis (e.g. horizontal). The second axis is therefore for instance perpendicular to the first. A single driving means (preferably a single turbine powered by washing liquid) is connected via gears and a clutch mechanism to rotate the housing about the first axis and via other gears to pivote or rotate the nozzle about the second axis, the ratio of the angular speeds of the nozzle and housing about their respective axes being constant, but the absolute angular speeds being varied in accordance with a selected program.

By choosing different washing programmes, the speed of rotation of the nozzle about the first axis, and the speed of oscillation about the second axis can be altered to meet the requirements of the particular tank being cleaned.

The programmes are selected by the profile of a cam and a shift between different programmes is done by a shift to another profiled cam.

This is difficult and timeconsuming because the only possibility of altering the program is to change the cam, and the nozzle movement and herewith the cleaning pattern are not easily altered, which means that further cleaning time and cleaning fluid must be used in such cases where the cleaning is not adequate and must therefore be repeated until all deposits are removed. In practise, this will typically be in the corners in the bottom of the tank.

OBJECT OF THE INVENTION

It is therefore the object of the invention to provide an apparatus which by a simple mechanical drive can provide a stepless variable setting of the swinging movement of the nozzle in that the drive of the apparatus must be able to withstand the tough surroundings of a tank vessel.

This object is achieved by an apparatus of the type disclosed in the preamble, which apparatus according to the invention is characteristic in that the drive also turns a worm shaft and a worm wheel, said worm wheel being provided with a stud which is in sliding engagement with a connecting link, the other end of which is in sliding engagement with a stud on a first pinion which, upon rotation of the worm wheel, turns the first pinion forwards and backwards, said first pinion being in engagement with a rack which, at its opposite end, is in engagement with a second pinion on the nozzle, so that the nozzle effects a swivelling movement.

ADVANTAGES OF THE INVENTION

In the event of a tank being extremely dirty, the apparatus according to the invention permits stepless setting to a tightly-meshed pattern of movement for the nozzle, which ensures the most effective cleaning in the shortest possible cleaning time in that the drive, apart from having a simple construction in terms of its operation, is also strong and offers an effective swinging movement of the nozzle.

The apparatus according to the invention also makes it possible to vary the oscillating speed of the nozzle in a stepless manner during operation so as to obtain an effective cleaning, in that the density of the track of the jet, and thus its intensity, can be adjusted to suit requirements. This will save time, cleaning fluid as well as energy, in that the distance between the jets during rotation inside the tank can be adjusted to provide a perfect cleaning result.

Also, by adjusting the speed at which the nozzle is oscillated, it is ensured that an optimum degree of efficiency is achieved, because cleaning can be effected with from very great to less adjacency and hence intensity with which the cleaning jet sweeps the inside of the tank.

By allowing the radius of the worm wheel to be less than that of the gear wheel, a rack movement is achieved which provides the nozzle with an angle of more than 180° in the vertical plane. The nozzle will therefore be able to swing between an upper vertical position, in which the nozzle points upwards, and a lower inclined position in which the nozzle points at an angle downwards, pointing towards the furthermost area of the bottom which experience has shown is the dirtiest, this area thus being effectively cleaned at the turning point of the nozzle.

By giving the worm wheel a variable degree of turning, the desired possibility of stepless adjustment of the speed of movement is achieved, and herewith of the speed at which the nozzle oscillates.

Finally, it is expedient to configure the adjustment as a limitation of the stroke length of the drive unit by means of a manually-rotatable eccentric disk, whereby a simple and reliable means of adjustment is achieved.

THE DRAWING

Figure 2:
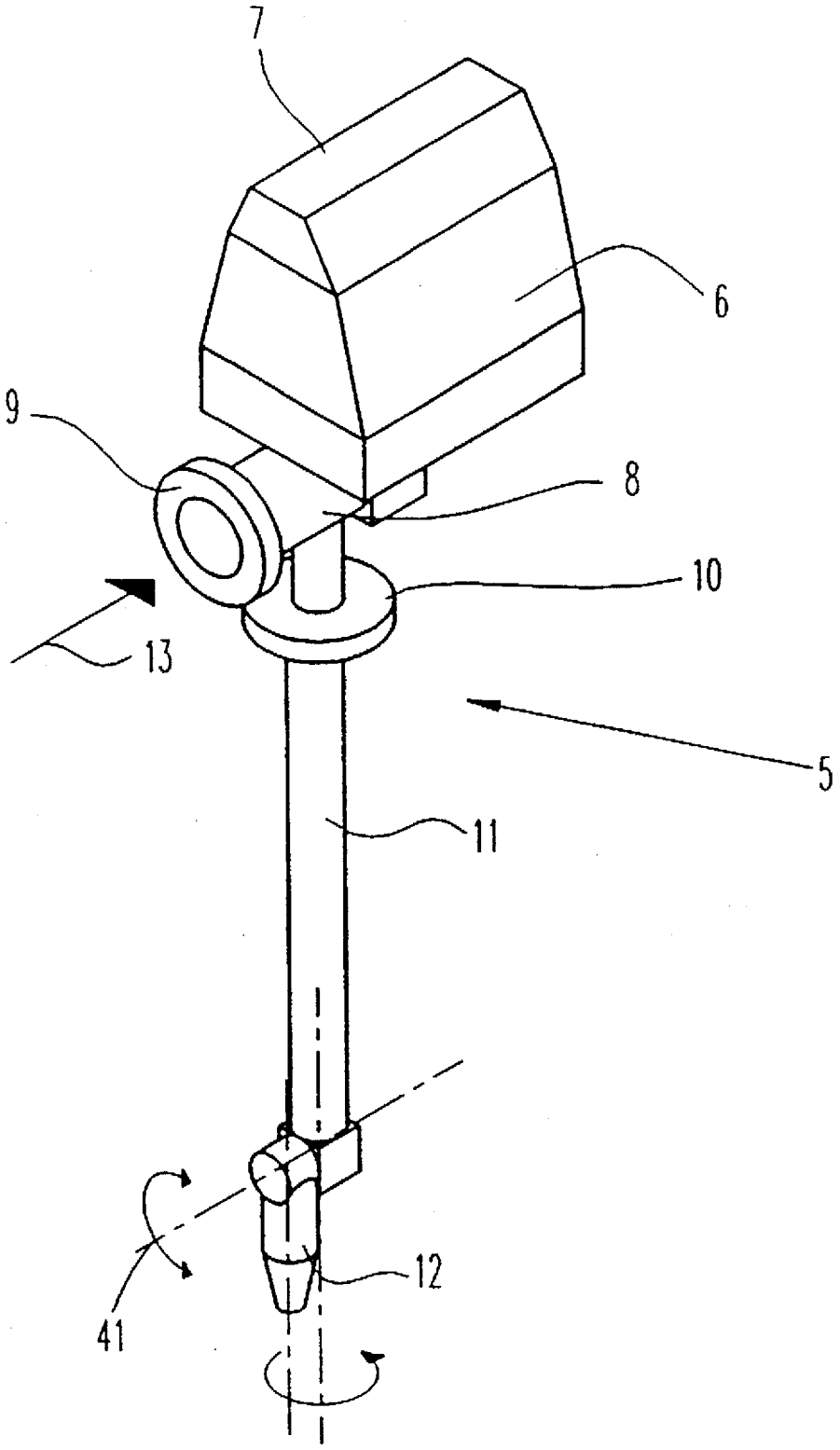
Figure 3:
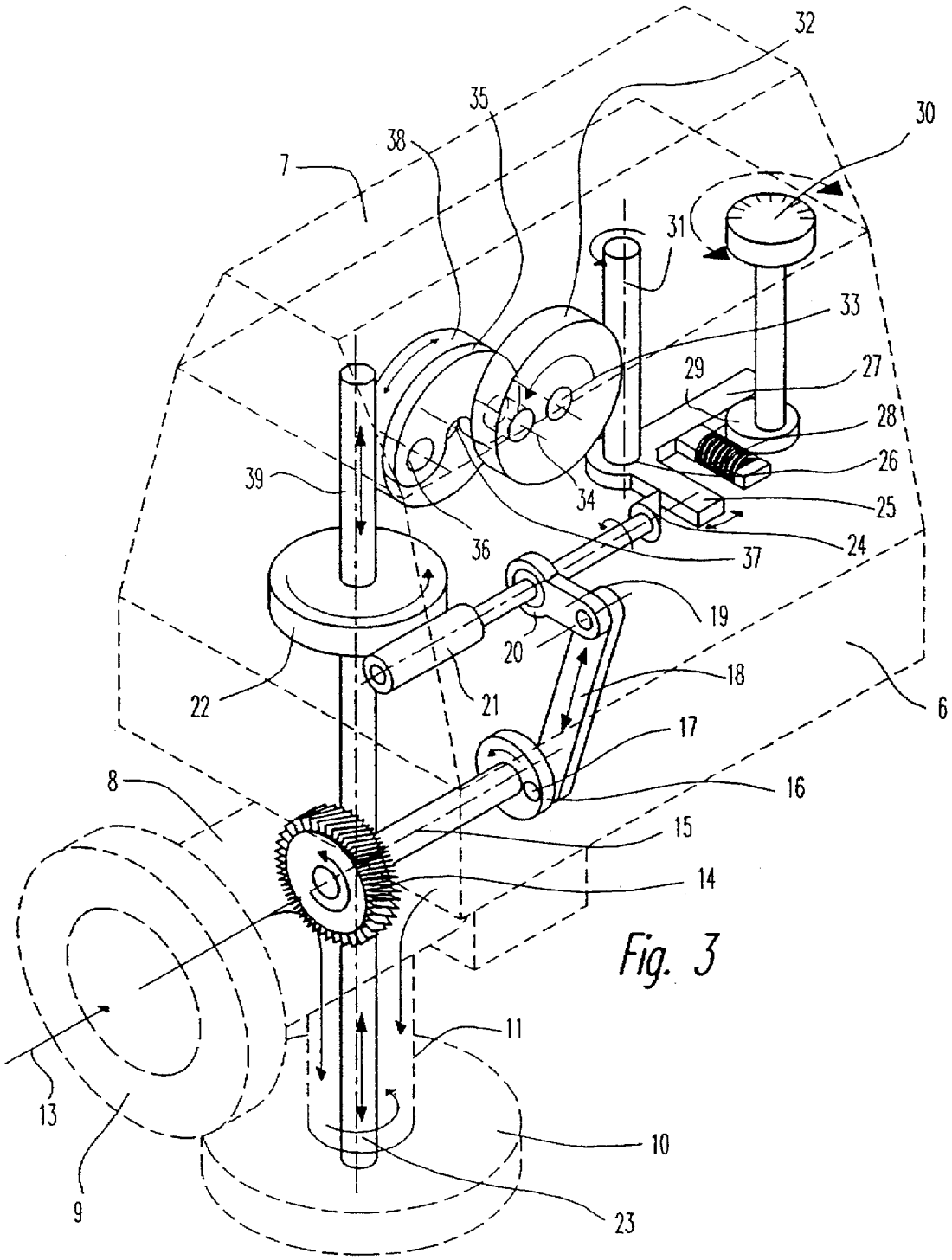
Figure 4:
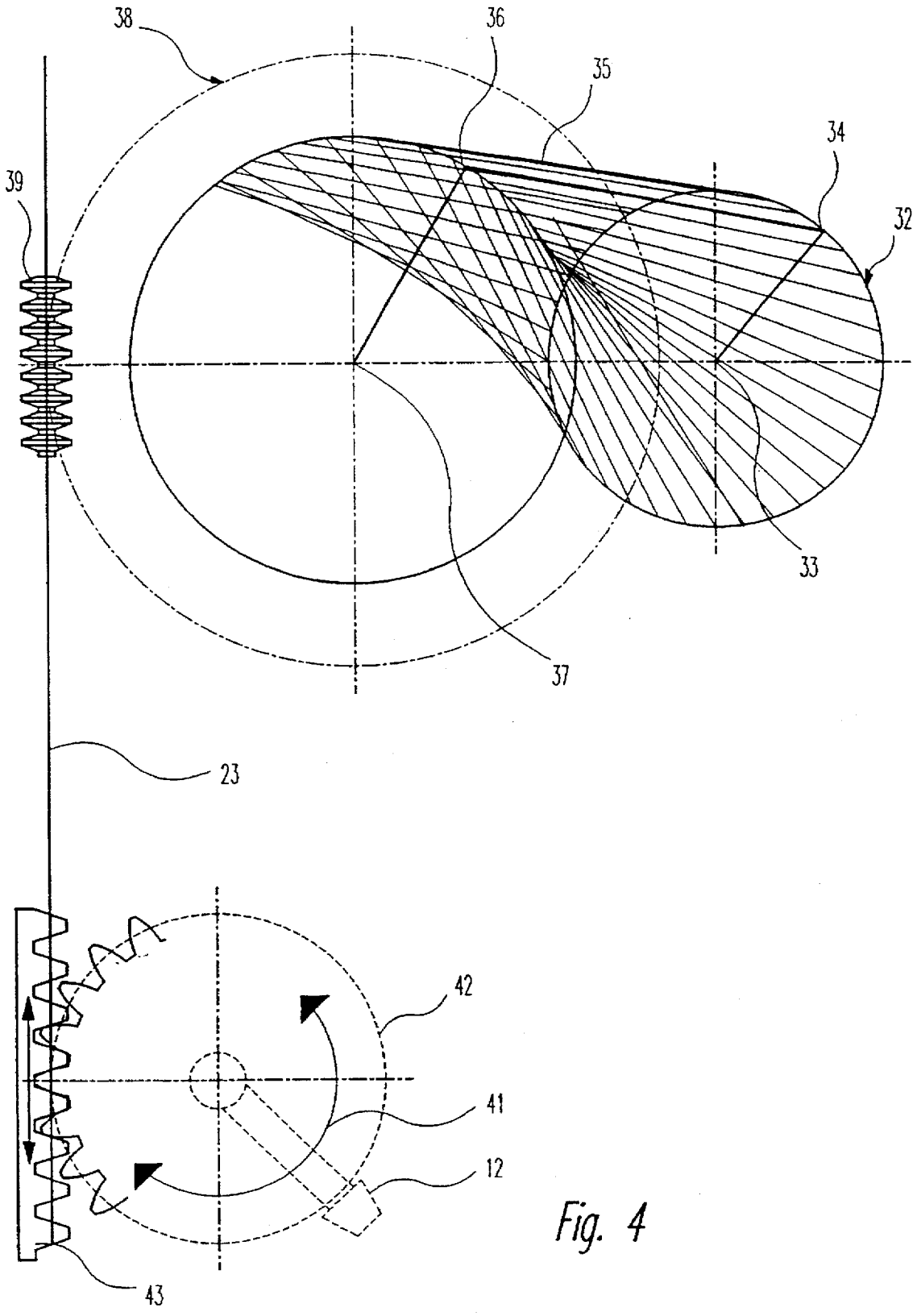
Figure 5:
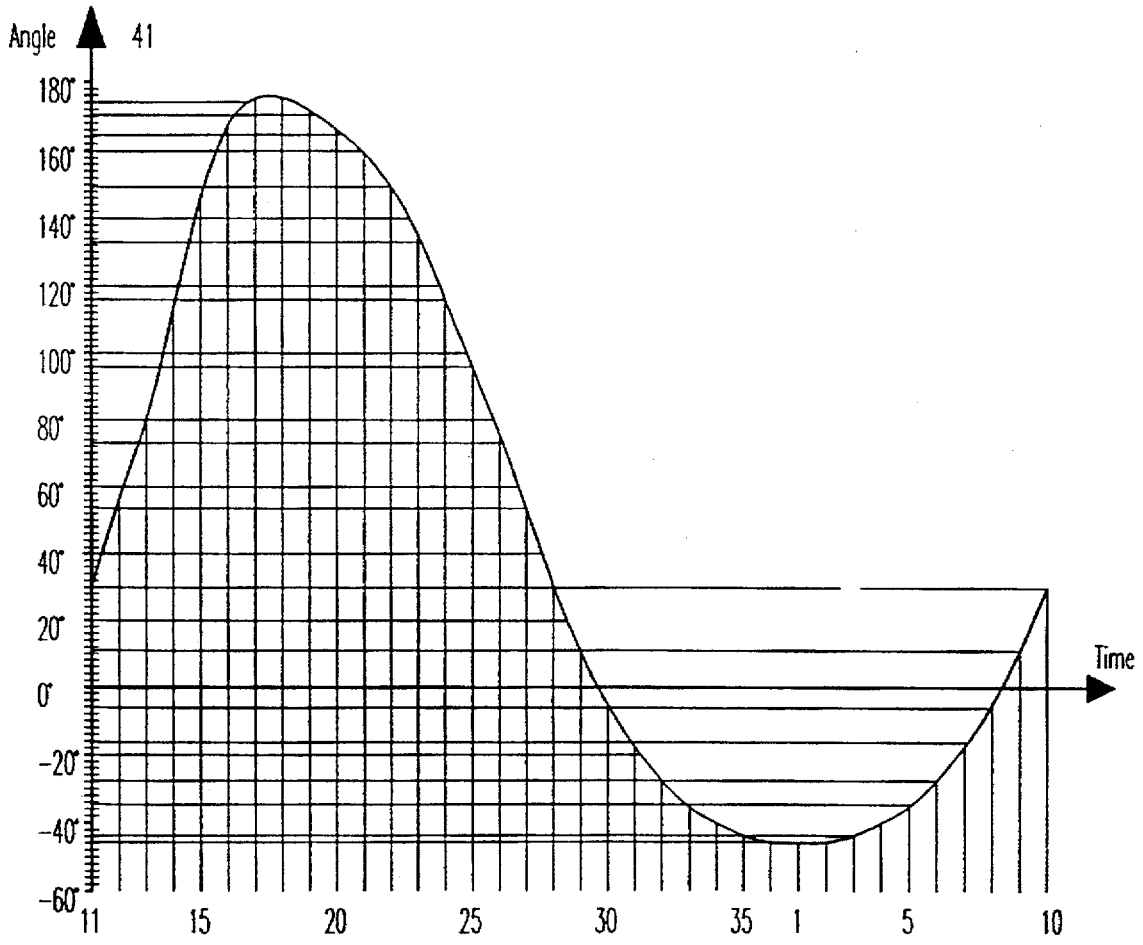
Figure 6:
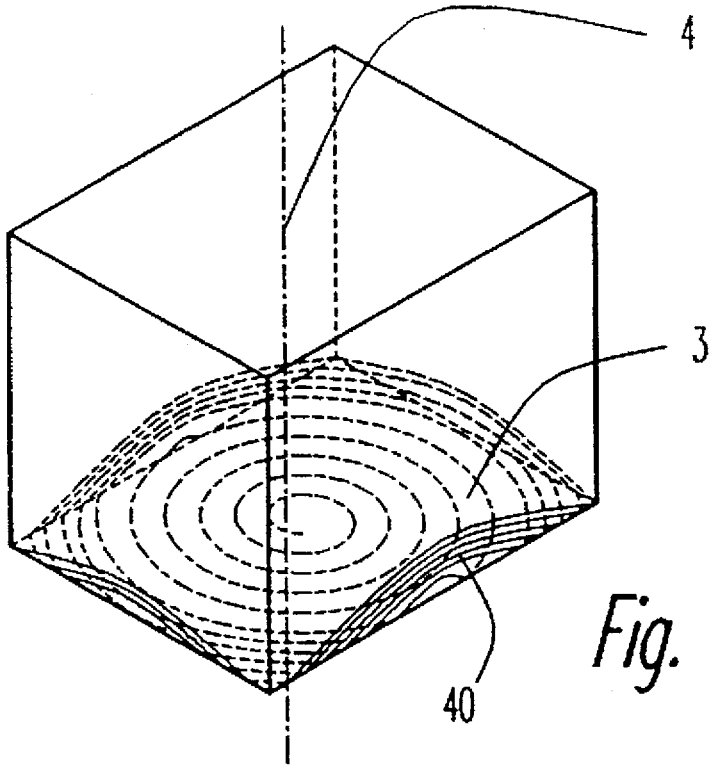

In the following section, an example embodiment of the invention will be described in more detail with reference to the drawing, where FIG. 1 shows an example of the mounting of the apparatus on the top of a tank, FIG. 2 shows the apparatus itself, FIG. 3 shows the drive unit itself, FIG. 4 shows a geometric illustration of a cycle in the degree of nozzle oscillation, FIG. 5 shows a graph which depicts the angular position of the nozzle in relation to time, and FIG. 6 shows an example of a pattern of movement followed by a cleaning nozzle at the bottom of a tank.

DESCRIPTION OF THE EXAMPLE EMBODIMENT

In FIG. 1 is shown an example of the mounting of a cleaning apparatus 5 on the top of separate tanks 1 or sections of the tank. The tank itself comprises the sides 2, the bottom 3 and the top on which the apparatus 5 is mounted at a place 4 expedient for the cleaning.

Each apparatus 5 is provided with a nozzle 12 which can be traversed around in the tank while at the same time it swings upwards and downwards, as will be described later.

An embodiment of the actual cleaning apparatus 5 is shown in FIG. 2.

This comprises a drive unit for the nozzle, said drive unit being outside the tank and built into a housing 6 with a cover 7 and a flange connection 9 for Cleaning fluid 13, a turbine housing 8 and a mounting flange 10 for abutment against the top of the tank.

Extending inside the tank 1 there is a pipe 11 on the end of which the nozzle 12 is mounted in such a manner that it can be turned around in the horizontal plane while at the same time it can be swung upwards and downwards oscillating in an arc 41, as indicated in FIG. 2.

The mechanism for turning the nozzle 12 and for the regulation of the nozzle's pattern of movement inside the tank 1 will be described with reference to FIG. 3, where the housing 6, the cover 7, the flanges 9 and 10 as well as the turbine housing 8 and the pipe 11 are indicated with stippled lines.

In the turbine housing 8 there is a turbine rotor 14 suspended in the flow of fluid 13 which is led from here down through the outer pipe 11 to the nozzle at the end of the outer pipe 11.

The turbine rotor 14 drives a shaft 15 to which there is connected a crankwheel 16 with a crank 17. On this crank 17, suspended in a sliding manner, there is a pushrod 18 which at its opposite end is connected to a rocker arm 19. The end of this rocker arm 19 is provided with a one-way clutch 20 of commonly-known type for the transfer of the rocking movement to a turning movement on a worm shaft which is hereby turned in only one direction.

The worm 21 on the shaft is in engagement with a worm wheel 22 which is turned as a result of the drive mechanism.

To the worm wheel 22 there is secured a downwardly-extending main shaft 23. The nozzle 12 is mounted on the end of said shaft 23 in such a manner that the turning movement of the worm wheel 22 is transferred to the nozzle 12, which is hereby rotated in the horizontal plane inside the tank, as indicated in FIG. 2.

The speed of the turning movement depends solely on the speed of rotation of the turbine rotor 14 and the gearing exchange effected by the drive unit.

The turning speed can therefore only be regulated by means of a not-shown arrangement for the regulation of the flow of fluid 13 through the turbine housing 8, or by changing the stroke length of the crank 16, 17.

In addition to this turning of the nozzle 12, the nozzle 12 is swivelled upwards and downwards in an oscillating movement 41, as indicated in FIG. 2.

This movement is brought about by a drive head 24 with an inclined slide surface which lies up against a carrier arm 25. This arm 25 is provided with a dog 27 which, assisted by a spring 28, lies up against an eccentric cam 29.

To the eccentric cam 29 there is fastened an adjustment wheel 30 so that the clearance of the carrier arm 25 in relation to the drive head 24 can be adjusted in a stepless manner. The turning movement of a worm shaft 31 which, via a one-way clutch 26 is mounted on the arm 25, 27, can hereby be steplessly varied.

The worm shaft 31 is in engagement with a worm wheel 32 which is mounted on a shaft 33. In the worm wheel 32 there is provided a stud 34 on which there is mounted a connecting link 35. At its opposite end, the link is connected to a stud 36 on a pinion 38 which is mounted on an axle 37.

When the worm wheel 32 is turned, the pinion 38 is moved forwards and backwards on the axle 37.

The pinion 38 is in toothed engagement with a rack 39 which extends tangentially to the pinion, and which is hereby moved upwards and downwards while at the same time being rotated by the worm wheel 22. At the opposite end of the main shaft 23 there is mounted a rack 43 which is in engagement with a pinion 42. The nozzle 12 is mounted on this pinion 42 in such a manner that the nozzle is swivelled upwards and downwards in an arc 41, as indicated in FIGS. 2 and 4.

The speed, which is determined by the turning angle of the adjusting arm 25 and herewith by the speed of rotation of the worm shaft 31, is determined by the position of the eccentric 29. Since this can be changed in a stepless manner, the speed can hereby be varied from a low to a higher speed, i.e. depending on the movement of the carrier arm 25 by the drive head.

In order to clarify the forwards and backwards movement of the pinion 38, the geometric relationships are depicted in FIG. 4, where the pinion 38 is indicated turning around its axis 37. The connecting link 35 extends between the points of application 36 and 34 on the worm wheel 32 which turns around its axis 33.

It will be noted that the radius of the worm wheel 32 is less than the radius of the pinion 38.

With stippled lines, FIG. 4 also shows the rack 39 which at its opposite end of the main shaft 23 is provided with a rack 43 which is in engagement with the nozzle's 12 pinion 42.

It appears clearly from the drawing that when the pinion 38 is moved over an angle of more than 180°, then the nozzle's pinion 42 will be made to effect a turning movement of more than 180°.

For the sake of clarity, there is sketched in a given position of the vectors between the centres 33 and 37 and the studs 34 and 36.

By changing the radius of the worm wheel 32 to the stud 34 and the length of the connecting link 35, both the length of the swivelling movement 41 of the nozzle 12 as well as the turning angle of the nozzle 12 can be adjusted. These can hereby be adjusted for the individual tank.

The following is a description of the mode of operation of the cleaning apparatus:

In FIG. 6, it is indicated with curves 40 how the intensity of the jet extends inside a tank. The cleaning apparatus is envisaged as being placed in the centre 4 at the top of the tank, and in this case the nozzle 12 is dimensioned to be swivelled in an arc of 180° from the vertical up to the vertical down.

The start position of the nozzle is upwardly-directed, and it is seen that it distributes the jet uniformly in the tank during its movement. The closeness of the curved lines 40 indicates that the nozzle is operated at a low swivelling speed. This is adjusted via the rotary disk 30 for short angular rotation over the eccentric 29, which provides only a short rocking movement of the arm 25 and herewith slow rotation of the worm shaft 31 and therewith finally limited movement of the rack 39 and herewith the pinion 42, as indicated in FIGS. 3 and 4.

When a more dispersed cleaning pattern is desired with greater nozzle swivelling speed, the eccentric 29 must be turned towards greater angular rotation and herewith greater rocking movement of the arm 25 to produce a high speed of rotation of the pinion 42 at the nozzle.

The cleaning intensity can be steplessly adjusted to ensure adequate cleaning of the tank and no more. This is naturally of great importance for the economy, in that there is no need to clean more than necessary, and that this adjustment of the intensity can take place by stepless adjustment.

Since there is normally a need for extra cleaning particularly of the corners at the bottom, it is expedient to use a construction like that which is shown in FIG. 4, where the nozzle can turn at the furthermost corners, in that the rocking movement can extend from the vertical and pointing to opposite corners.

FIG. 5 shows graphically how the nozzle 12 and herewith the jet are oriented for most of the time, the absciss, in the area between 50° and −50°, which is just above the bottom, while the 180° on the ordinate means that the nozzle points upwards for a shorter period of time.

From this it will be clear that an extraordinarily effective cleaning is achieved of precisely those areas inside the tank which are normally the most dirty. An attempt to illustrate this is also made in FIG. 6, which shows the cleaning which is achieved in the corners where the nozzle turns, and where the cleaning intensity of the jet path 40 is at its greatest.

This cleaning pattern is unique for the apparatus and provides a hitherto-unknown high degree of efficiency, and herewith savings in both energy and cleaning fluid as well as time.

The apparatus can be provided in a commonly-known manner with indicators for the nozzle's position both in the vertical and the horizontal planes, so that the starting position for the nozzle can be adjusted in accordance with requirements before the cleaning commences.

The speed at which the nozzle is swivelled can be read from the rotary disk on the eccentric, and herewith the intensity of the cleaning pattern.

Where there is need for a programmed control of the cleaning pattern, the eccentric can be made rotatable by means of a servo motor, whereby an adjustment and regulation can be effected for achieving the most expedient cleaning for the individual tanks.

I claim:

1. An apparatus for cleaning the inside surfaces of a tank comprising a nozzle lowered into the tank, a jet of fluid issuing from the nozzle for cleaning the inside surfaces of the tank, the nozzle being capable of being rotated around a first axis and being capable of being swivelled upward and downward in an oscillating movement around a second axis at right angles to the first axis in a predetermined manner, so that the jet of fluid is traversed around the first axis at the same time that the jet is moved upwards and downwards inside the tank, a turbine, driven by a stream of fluid, drive means connected to the turbine for rotating the nozzle, the drive means having a worm shaft, a worm wheel engaged with the worm shaft, a first stud provided on the worm wheel, a first pinion having a second stud thereon, a connecting link having a first link end in sliding engagement with the first stud on the worm wheel, a second link end in sliding engagement with the second stud on the first pinion such that rotation of the worm wheel moves the first pinion forwards and backwards, a rack having a first end and a second end, the first pinion being in engagement with the first end of the rack, a second pinion connected to the nozzle, the second end of the rack in engagement with the second pinion for effecting the swiveling upward and downward oscillating movement of the nozzle.

2. The apparatus according to claim 1, wherein a radius of the first stud is less than a radius of the second stud.

3. The apparatus according to claim 2, further comprising turning the worm shaft using a variable drive unit.

4. The apparatus according to claim 3, further comprising providing a rotatable eccentric disk for limiting a stroke length of the drive unit and thereby limiting the turning of the worm shaft.

5. The apparatus according to claim 1, further comprising turning the worm shaft using a variable drive unit.

6. The apparatus according to claim 5, further comprising providing a rotatable eccentric disk for limiting a stroke length of the drive unit and thereby limiting the turning of the worm shaft.

* * * * *